United States Patent [19]

Despins et al.

[11] Patent Number: 5,010,650

[45] Date of Patent: Apr. 30, 1991

[54] SEAM CUTTER

[75] Inventors: Maurice Despins; William Carveth, both of Edmonton,, Canada

[73] Assignee: Omnimart Distributions Inc., Edmonton, Canada

[21] Appl. No.: 239,898

[22] Filed: Sep. 2, 1988

[51] Int. Cl.[5] ..... B26B 3/00

[52] U.S. Cl. ..... 30/304; 30/299; 30/329

[58] Field of Search ..... 30/299, 304, 329, 294, 30/335

[56] References Cited

U.S. PATENT DOCUMENTS 2,787,057 4/1957 Bell ..... 30/299
2,902,713 9/1959 Buelow ..... 30/299 X
4,620,368 11/1986 Bowman ..... 30/329 X

*Primary Examiner*—Hien H. Phan
*Assistant Examiner*—Willmon Fridie, Jr.
*Attorney, Agent, or Firm*—Anthony R. Lambert

[57] ABSTRACT

A trace edge cutter and salvage edge cutter are described for use in cutting flooring materials. The cutter includes a cross-wise handle for ease in pushing the cutter, greater width for stability, a recessed portion along the guiding edge to increase stability of the guide, even when worn, two-step adjustment of blade position and guide, a friction lock mechanism for preventing movement of the blade, removable guides, grooves on the base of the cutter for deflecting particles and use of two guiding edges on the same cutter for trace edge cutting.

18 Claims, 3 Drawing Sheets

SEAM CUTTER

FIELD OF THE INVENTION

This invention relates to cutting devices for cutting seams in flooring material, particularly vinyl flooring material.

BACKGROUND OF THE INVENTION

When flooring material, particularly vinyl flooring material, is laid on a floor, the adjoining edges of the two pieces of flooring material must fit together precisely so that there are no gaps between the adjoining strips and no overlapping portions. To do this knives have previously been used to cut through overlapping and adjoining pieces of flooring material, so that the same cut was used to make the cut in both the upper and the lower pieces of flooring material. The result was usually a seam in which the edges were not perpendicular, and did not fit together very well.

Another method of cutting seams involved the use of an underscriber device, which hooked on the bottom edge of the material being cut, with a needle above this edge for gouging the top of the material. A cut was then made with a knife on the scribed line. The result was a rough and often irregular cut. The underscriber could not be used for all flooring materials.

To solve the difficulties of using a knife, with or without an underscriber, a dual cutting system was developed in which a first cutter, called a salvage edge cutter, cut the upper layer of flooring material using the edge of the upper layer of flooring material as a guide. This cut was made a few millimeters away from the edge. The salvage edge cutter consisted primarily of a guiding edge and a blade separated from the guiding edge by a few millimeters. As the guiding edge moved along the edge of the upper layer of flooring material it tended to average out the roughness of that edge, so that the cut made by the blade was relatively smooth.

A trace edge cutter was then used to follow the resulting edge and cut down into the lower layer of flooring material. The trace edge cutter was similar to the salvage edge cutter except the blade was closely adjacent to the guiding edge so that the blade essentially followed the edge of the flooring material.

These devices tended to be two to four centimeters wide. One used a single screw to hold the blade, and had a fixed guiding edge. Another used a single screw and pressure plate to hold the blade, with a moveable guide clamped by several screws. Another device used two screws to hold a moveable guide, one of which also held the blade.

Another device, called the Kombi, could be used as both a trace edge cutter and a salvage edge cutter. In this device, a fixed guiding edge was spaced from the blade by a spacer plate. The spacer plate was moveable from a position in which it left a gap between the blade and guiding edge, and a position in which it extended as far downward as the guiding edge so that the side of the spacing plate next to the blade became the guiding edge. The guiding edge itself remained fixed.

These prior art devices had all of the following disadvantages. They were narrow, and therefore unstable. As a result, it was difficult to hold the blades upright. The resulting seam was likely to be peaked or leave open spaces. In addition, as the guiding edge wore at its ends with use, the cutter would rock about the guiding edge, causing the blade to wander away from the edge of the material and create an open seam.

In addition, they used numerous screws, or if only one screw, the screw only adjusted the blade. If the guiding edge was adjustable, it was only adjustable below the base of the cutter, so that the base itself could never be a guiding edge. The guiding edge was narrow and could not function as a stable support.

In addition, the bases of these cutters were planar, and made of aluminum or BAKELITE, (a trade mark of Union Carbide Corp.) which would become scratched by grit moving under the bases, and would mark the floor. Aluminum also tended to peel, and be gouged by grit, and the pieces of aluminum that would be gouged out of the base would also tend to mark and gouge the floor.

Furthermore, the blades of these devices were susceptible to movement, and were not easily adjusted. If placed in a groove within the cutter, the blade tended to be damaged by contact with the edges of the groove.

These devices also only used one guide for trace edge cutting which tended to wear that guide excessively. In addition, these devices had thin length-wise handles, which were difficult and tiring to grip, and their guiding edges were not replaceable.

All of these disadvantages are solved by one or other of the embodiments of the present invention, and the present invention gives other advantages as set out in detail in this patent.

SUMMARY OF THE INVENTION

In one embodiment, there is provided a cutter for cutting seams in overlapping upper and lower flooring materials, in which the edge of the upper flooring material is exposed, the cutter comprising:

a body having a handle defining an upper end of the body and having a forward longitudinal end and a rearward longitudinal end;

a base defining a lower end of the body and elongated in the longitudinal direction for supporting the body on one of the upper and lower overlapping flooring materials, and having a first guiding edge extending between the forward longitudinal end and the rearward longitudinal end of the body;

a foot connected to the body adjacent to the base for supporting the body on the other of the lower and upper flooring material and having a second guiding edge extending between the forward longitudinal end and rearward longitudinal end of the body;

a blade slidably disposed against the body between the foot and the base for cutting the flooring material;

one of the first and second guiding edges having a laterally recessed portion between the forward longitudinal end and the rearward longitudinal end of the body, so that the vertical edge of the upper flooring material does not contact the guiding edge in the recessed portion in use; and fastening means for fastening the blade at a chosen position in relation to the body.

In another embodiment, there is provided, a cutter for cutting seams in upper and lower overlapping flooring materials, in which the edge of the upper flooring material is exposed, the cutter comprising:

a body having a handle defining an upper end of the body, and having a forward longitudinal end and a rearward longitudinal end and a slot oriented forward and downward in the body, the slot being open laterally;

a blade slidably disposed against the body and adjacent the slot for cutting the flooring materials;

a base defining a lower end of the body and elongated in the longitudinal direction for supporting the body on one of the upper and lower overlapping flooring materials, and having a first guiding edge extending between the forward longitudinal end and the rearward longitudinal end;

a foot connected to the body adjacent to the base for supporting the body on the other of the lower and upper flooring materials and having a second guiding edge extending between the forward longitudinal end and the rearward longitudinal end of the body; and blade fastening means for fastening the blade at a chosen position in relation to the body between the foot and the base upon upward and rearward pressure on the blade, the blade fastening means including a member connected to and protruding from the blade into the slot, the member having parts separated from each other in the direction of the slot for contacting the walls of the slot and having a high degree of friction with the slot.

Still further embodiments of the invention can be found in the claims.

BRIEF DESCRIPTION OF THE DRAWINGS

Reference will now be made to the accompanying drawings which illustrate a preferred embodiment of the invention by way of example, and in which.

DESCRIPTION OF THE PREFERRED EMBODIMENTS

Figure 1:
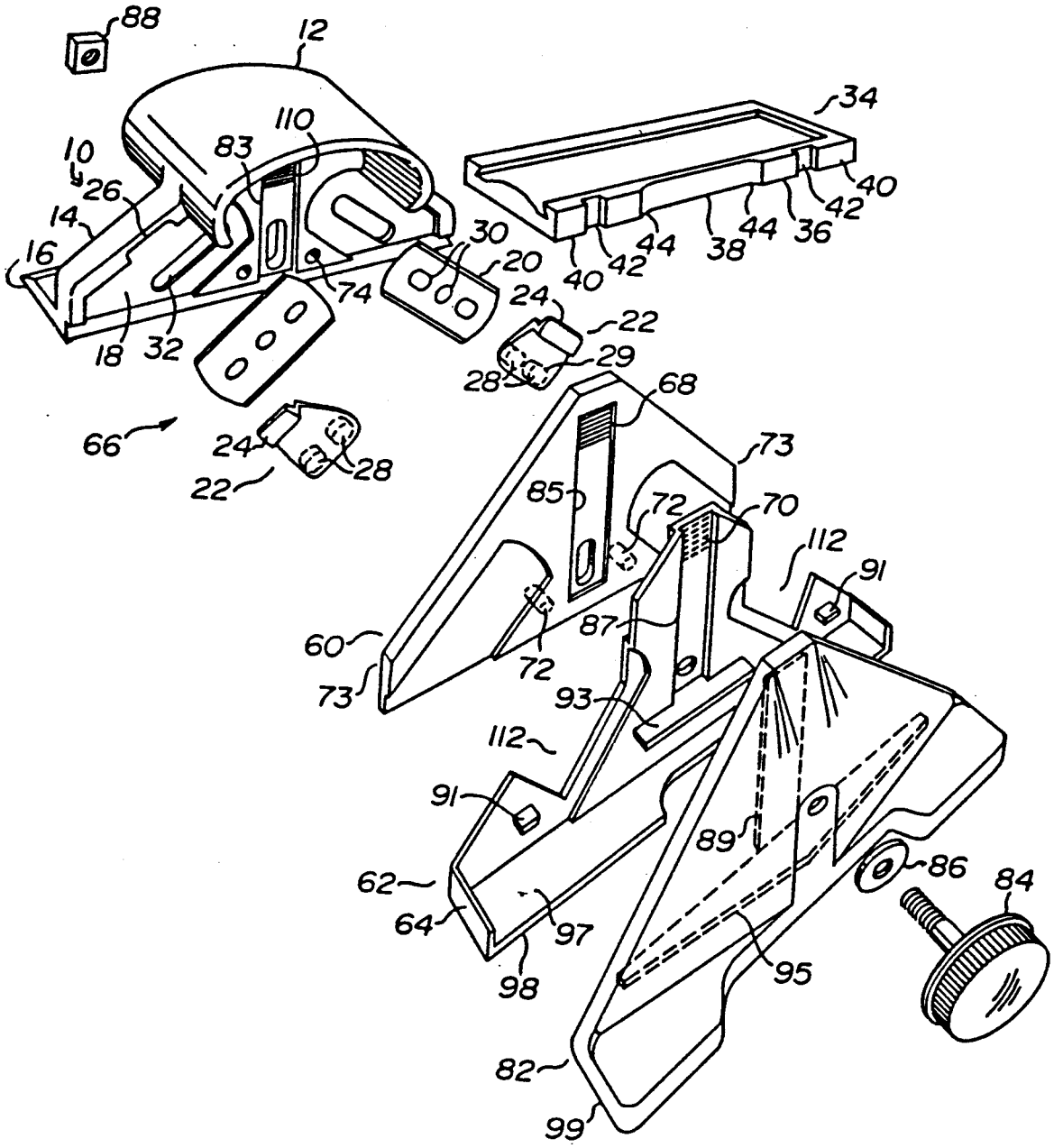
FIG. 1 is a perspective of a cutter according to the invention showing the disassembled cutter.

For a better understanding of the invention there will now be described a cutter according to the invention. Referring to FIG. 1, the body of the cutter shown generally at 10 may be used for both the salvage edge cutter shown in FIG. 6 and the trace edge cutter shown in FIG. 8. The body is made of rigid material, preferably die-cast aluminum.

Handle 12 is integral with the body, and laterally oriented. Preferably it is also smoothly curved and convex upward, for ease of pushing the cutter from either end and with either hand. Center piece 14 of body 10 is integral with the handle 12.

Shoe retainer 16 is also integral with the center piece, and is at least two and preferably three centimeters wide to give stability to the body. Grooves 18 in center piece 14 are for receiving blades 20. Blade adjusters 22 have grip surfaces 24, which when assembled extend outside the body at notches 26 (one not shown). We obtain our blades from Technic Inc., of N.J.

Pins 28, on the reverse side of blade adjusters 22 in FIG. 1, are integral with the blade adjuster and pass through openings 30 in blades 20. The pins extend into slots 32 in center piece 14, and may slide within the slots 32.

Movement by hand of grip surfaces 24 in notches 26 moves the blades 20 in grooves 18. The blades 20 may be adjusted to a suitable degree of extension below the body. The choice of length and position of the grooves 18 and slot 32 varies the maximum and minimum ranges of adjustment of the blades 20.

In use, only one of the blades 20 is used, the one chosen being dependent on the direction of movement of the cutter The blade used should be at the rear of the cutter. Force from cutting on blade 20 causes the blade 20 and pins 28 to rotate in the slots 32. The pins 28 push against the walls of the slot 32, one against each opposing wall, causing frictional forces between the pins 28 and slot 32 great enough to lock the blades 20 and adjusters 22 within the slot. The frictional lock may be created solely by the frictional forces between the pins 28 and the walls of the slots 32. Whether the frictional forces are strong enough to create a lock depends on the coefficient of friction between the pins 28 and the walls of the slots 32, the distance from the end of the blades 20 to the pins 28, and the distance between the pins 28. We have used aluminum for the body and pins, which provides a relatively high coefficient of friction between the slots 32 and pins 28. Force on one of the blades 20 makes the blade a lever arm which rotates about pins 28. The greater the distance of the end of the blade from the pins, and the closer the pins, the greater the locking effect. For a certain material, the correct position of the pins may be determined by calculation.

The pins 28 have flattened sides 29, so that an angular edge is created to assist in making a high friction contact with the walls of the slots 32. Flattening the sides of the pins 28 also helps to prevent the pins 28 from becoming loose in the slots 32 as the sides of the pins 28 wear with use. For some applications, if desired, the walls of the slots 32 may be serrated, to enhance the binding effect.

Appropriate choice of the widths of the grooves 18 prevents the edges of the blades 20 from being damaged in the grooves 18 when the blades 20 are rotated slightly by the pressure from cutting. This, along with the locking mechanism described above, allows use of all four corners of the blade, rather than having them damaged in use. The material used for the slots 32 and pins 28 must have a sufficiently high degree of friction between them to permit this locking. Aluminum pins and aluminum slots have been found to be adequate for this purpose.

This fastening mechanism for the blades is in addition to the primary fastening mechanism using screw 84 and the guiding edges 36 and 64 of the shoe 34 and guide 62 respectively. The primary fastening mechanism is described below, and fastens the blades even without pressure being exerted on the blade. The blade frictional lock serves to fasten the blades when pressure is placed on them (that is, in use).

The shoe 34 of the cutter is removable and slidably fits on shoe retainer 16 and together the shoe retainer 16 and shoe 34 constitute a base as referred to in the claims. It may be tapered to assist in holding it on the shoe retainer 16. Shoe 34 is preferably made of low friction plastic such as nylon 6, and is about 1 cm. wider than shoe retainer 16. The shoe 34 has guiding edge 36, with recessed portion 38 so that, in use, the edge of the flooring material contacts the guiding edge 36 at ends 40 only. The recessed portion 38 extends between raised flat portions 40, which are also used for gripping the blades 20. The recessed portions 38 should be as long as possible since this creates maximum stability, but if they extend behind the blades 20 when the blades are extended, grit may enter the gap thus created and interfere with the operation of the blades 20. The upper surface of shoe 34 may have notches (not shown) above the ends 40 to minimize sinkage from plastic shrinkage.

As the guiding edge 36 wears, particularly at the ends 40, the recessed portion 38 allows the edge of the flooring material to contact only ends 40 so that, despite the wear, the guiding edge 36 does not rock about what would otherwise be its unworn center portion.

Wear indicators 42, of approximately equal depth to recessed portion 38, indicate when the guiding edge 36 is worn, and the shoe 34 requires replacing. Corners 44 of the recessed portion 38 are preferably rounded to prevent shoe 36 from being caught on the edge of the upper piece of flooring material.

Figure 2:
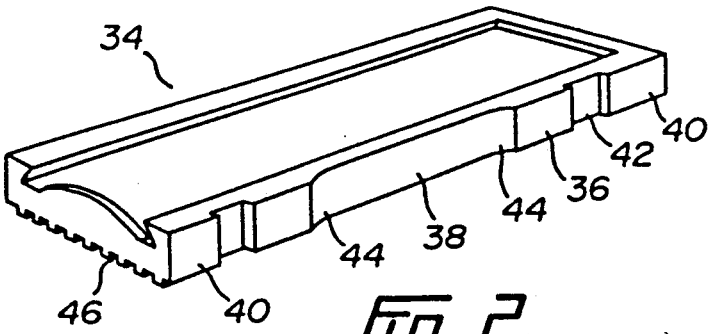
FIG. 2 is a perspective of a removable shoe for the cutter shown in FIG. 1.

The lower surface 46 of the shoe 34 may be ridged with longitudinal grooves extending along its length, as shown in FIG. 2, to help prevent grit from fouling the lower surface 46 of the shoe 34. The grooves are preferably about 1½mm. wide with 3 mm. ribs between the grooves to allow dust size particles to fit in the grooves. Wider grooves should not be required if the floor is relatively clean. The ends of the ribs may be tapered to deflect particles into the grooves.

Figure 3:
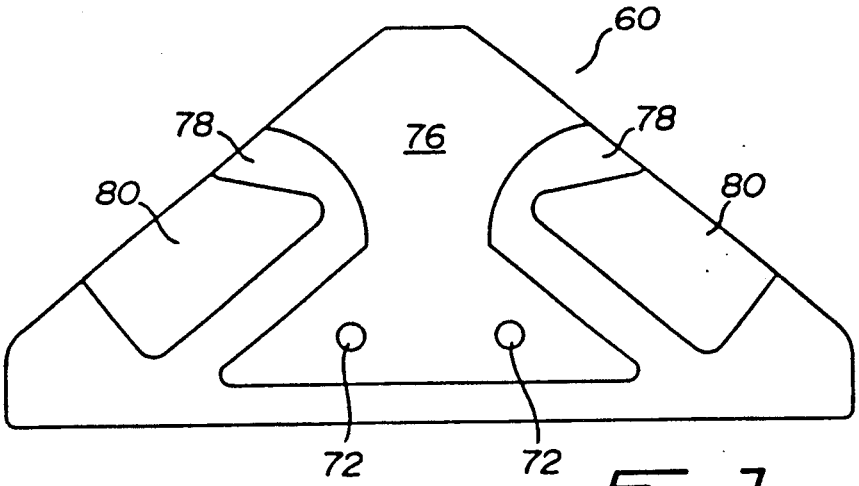
FIG. 3 shows a side elevation of the reverse side of the spacer plate shown in FIG. 1.

Again referring to FIG. 1, in the salvage edge cutter, spacing plate 60 fits between guide 62 having guiding edge 64 and the center piece 14. The cutting assembly shown generally at 66 consisting of blades 20 and adjusters 22 fits between spacing place 60 and center piece 14. Ridges 68 on spacing plate 60 receive complementary ridges 70 on guide 62. Spacing plate 60 fits against center piece 14 and projections 72 are received in cavities 74. Rear surface 76 of the spacing plate 60, not shown in FIG. 1, but shown in FIG. 3, has ridges 78 defining slots 80 for receiving the adjusters 22. The slots 80 should be deep enough to allow the sliding motion of the adjusters 22.

Guide 62 is preferentially made of low friction plastic such as nylon 6.

Holding plate 82 fits against guide 62 and together with guide 62 constitutes a foot as referred to in the claims. In the salvage edge cutter, screw 84, having washer 86 and nut 88, fits through holding plate 82, guide 62, spacing plate 60 and center piece 14. Ridges (not shown) on body 10 may be used to prevent rotation of nut 88. Tightening the screw 84 presses the holding plate 82 against the blade 20 which in turn presses against the ends 40 of the shoe 34 to hold the blade 20 firmly in place. Loosening screw 84 slightly (one quarter turn) allows the blade 20 to move freely, and loosening screw 84 a greater amount, depending on the depth of the ridges 68 and 70, allows adjustment of the guiding edge 64 at a chosen vertical position relative to the shoe 34. The holes for receiving the screw 84 in spacing plate 60 and center piece 14 are elongated to allow movement of the holding plate and screw up and down. Holding plate 82 and spacing plate 60 are both preferentially made of die-cast aluminum.

Figure 4:
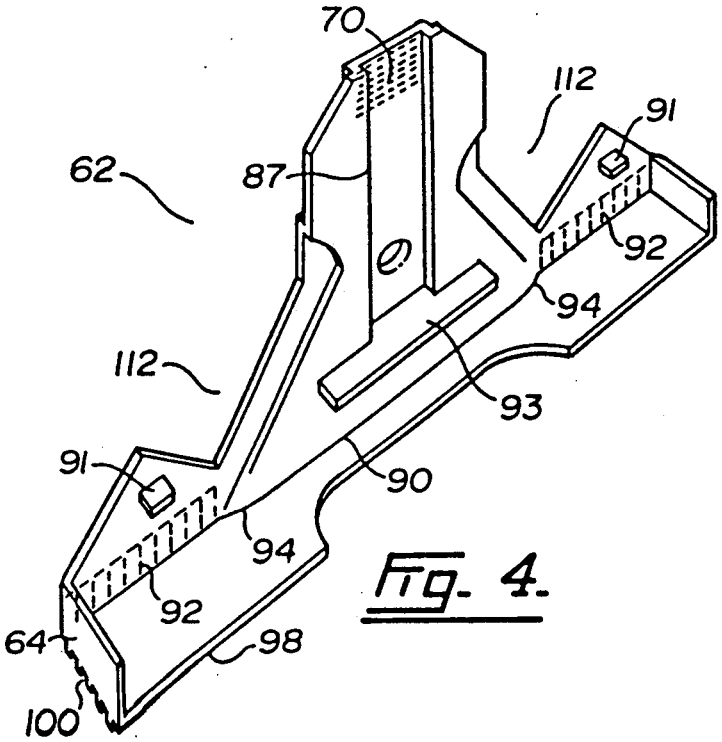
FIG. 4 shows a perspective of an alternative embodiment of the guide means shown in FIG. 1.

Referring to FIG. 4, guiding edge 64 of guide 62 may also have a recessed portion 90 (like the shoe 34), with raised ends 92 for abutting the edge of the flooring material, and also has rounded corners 94 to the recessed portion 90. The lower surface 98 of guide 62 may have longitudinal grooves 100, for the same reasons and in the same manner as for the shoe 34. Lower surface 98 of the guide 62 and base 99 of the holding plate 82 are preferably at least 1 cm. wide to assist in stabilizing the cutter. The raised ends 92 of the guiding edge 64 have limited vertical height so that the center of the force applied to the blades 20 on tightening of the screw 84 is relatively low. If the center of the force is high, the blades 20 may have an undesirable amount of flex.

In the trace edge cutter, holding plate 60 is not used, and guide 62 abuts directly onto center piece 14. Ridges 70 of guide 62 mate with ridges 110. Adjusters 22 slide in openings 112 in guide 62. When screw 84 is tightened, the pressure of guiding edge 64 against one of the blades 20 and ends 40 of guiding edge 36 of shoe 34 holds the selected blade 20 in place. A slight, preferably one quarter, turn of the screw 84 loosens the blade 20. Greater turning of the screw 84, depending on the depth of the ridges 70 and 112, and choice of the thread of the screw 84, allows adjustment of the height of the guide 62 against the shoe 34.

Appropriate selection of the positions of the ridges 68, 70 and 110 allows the lower surface 98 of the guide 62 in the salvage edge cutter to be lower than the lower surface 46 of the shoe 34, and, in the trace edge cutter, to be higher than the lower surface 46 of the shoe 34. In addition, in the trace edge cutter, lower surface 98 of guide 62 may also be adjusted above or below lower surface 46 of shoe 34, so that either of the guiding edges 36 or 64 may be used for trace edge cutting.

Projections 72 on spacer plate 60 project into cavities 74 in body 10 and are of sufficient length so that they remain in place when adjustments are made to the position of the guide 62 and shoe 34 as described below. Other means of holding the spacing plate 60 from longitudinal or vertical motion on loosening of the screw 84 may be used, such as tabs (not shown) at position 73 on the spacing plate 60 which mate with complementary notches (not shown) in the body 10. In the salvage edge cutter, vertical slot 85 and complementary vertical projection 87 assist in maintaining the lower surface of the shoe 34 and guide 62 parallel during adjustment of the shoe 34 in relation to the guide 62. In the trace edge cutter vertical projection 87 mates with vertical slot 83 for the same purpose. In both cutters, vertical ridge 89 on the holding plate 82 mates with the vertical slot created by the rear side of vertical ridge 87 in guide 62, for the same purpose.

Projections 91 and 93 on the guide 62 project into grooves 95 of holding plate 80. These assist in maintaining the upper surface 97 of the lower surface 98 of the guide 62 close to the base 99 of the holding plate 82. If they are not maintained near to each other, the flexibility of the plastic guide 62 tends to make the cutter unstable.

Figure 5:
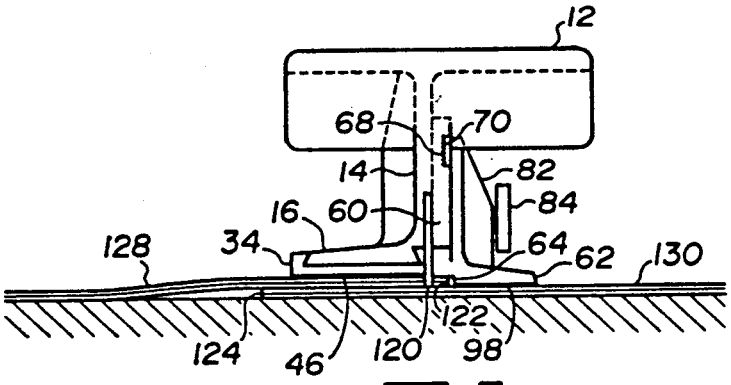
FIG. 5 is an end elevation of an assembled salvage edge cutter according to the invention.
Figure 6:
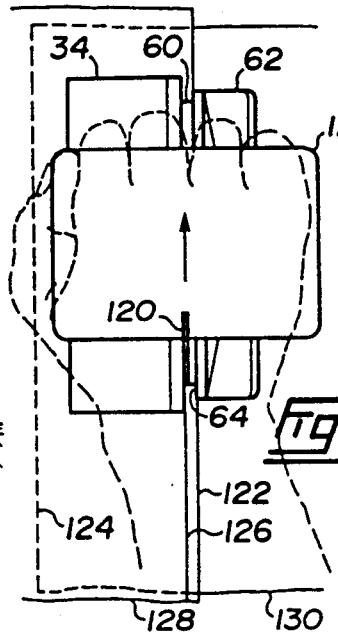
FIG. 6 is a top view of the salvage edge cutter of FIG. 5.
Figure 7:
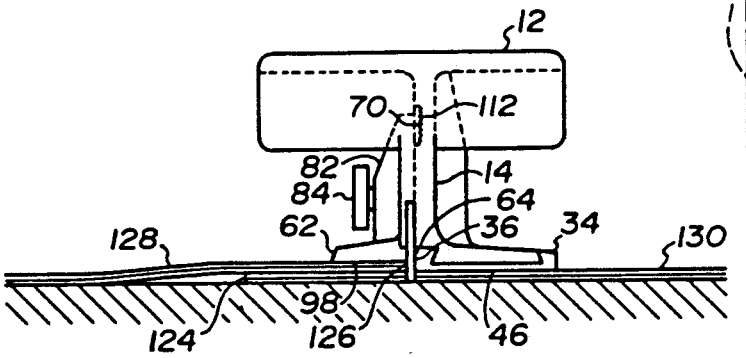
FIG. 7 is an end elevation of an assembled trace edge cutter according to the invention.
Figure 8:
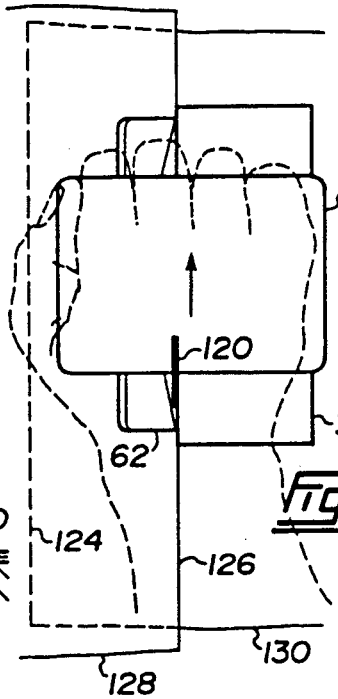
FIG. 8 is a top view of the trace edge cutter of FIG. 7.

The edge of the lower piece of flooring material is shown at 124 in FIGS. 5, 6, 7 and 8, the uncut edge of the upper flooring material at 122 in FIGS. 5 and 6, and the cut edge of the upper flooring material (trace edge) at 126 in FIGS. 7 and 8.

The assembled salvage edge cutter is shown in FIG. 5 in end view, and in FIG. 6 in top view. The salvage edge cutter is sitting on the overlapping upper flooring material 128 and the lower flooring material 130. Holding plate 82 is fastened by screw 84 against guide 62, spacing plate 60, one of the blades 20 (not shown in this figure but positioned at 120) and center piece 14. Guiding edge 64 is separated from the one of the blades 20 being used, which is located at position 120, by spacing plate 60. Guiding edge 64 abuts edge 122 of the upper flooring material. To ensure gripping of the blades, the spacing plate 60 should contact the center piece 14 and cutting assembly 66 only at the blade positions and adjustment ridges.

The cutter is shown in FIG. 6 in the right-handed position. For the left-handed position, the blade 20 on the other end of the cutter is used and the direction of travel is reversed. In both cases, slight pressure to press the guide edge 64 against the edge 122 of the flooring material is required. The one of the blades 20 being used should be adjusted to be extended below the lower surface 46 of the shoe 34 a distance equal to the thickness of the flooring material. Holding plate 82 and guide 62 are adjusted to a depth below the flooring material equal to the thickness of the flooring material. The number of ridges 68 which are exposed give an indication of the depth.

The assembled trace edge cutter is shown in FIG. 7 in end view and in FIG. 8 in top view. The trace edge cutter rests on overlapping flooring material 130 and underlying flooring material 128. Holding plate 82 abuts against guide 62 which abuts against the cutting assembly 66 (not shown in FIG. 8), holding the chosen blade 20 in position against center piece 14. To ensure gripping of the blades 20, the guide 62 should abut against the center piece 14 and cutting assembly 66 only at the blade positions and the adjustment ridges. The spacing plate 60 is missing so that the chosen blade 20 abuts the guiding edge 64 of guide 62. Ridges 112 and 70 mate, and allow adjustment of the lower surface 98 of guide 62 against the lower surface 46 of shoe 34. The height of adjustment may be determined by the number of ridges exposed.

In operation, guiding edge 36 abuts the cut edge 126 of the flooring material and cuts through the lower piece of flooring material. The blade shown at position 120 should be adjusted to a suitable depth below the lower surface 46 of shoe 34 to cut through the lower piece of flooring material. The edge of the flooring material between the cut 126 and edge 124 may then be removed after cutting with the trace edge cutter In operation, lateral pressure on the cutter should not be so great as to cause buckling of the flooring material, otherwise an uneven cut may result. All the wearing parts, that is, the shoe, guide and blades, are replaceable. The trace edge cutter and salvage edge cutter may be color coded to ensure the appropriate cutter is used.

The combined width of the lower surfaces 46 and 98 of the shoe 34 and guide 62 respectively is preferably at least 5 cm. wide, to ensure stability of the cutter. It is desirable that the shoe 34 and base 99 of the holding plate 82 have widths that are comparable so that the handle 12 is more or less centrally disposed on the cutter. This adds to the stability of the cutter. The symmetrical handle 12 permits use by either right or left-handed persons, and the lateral handle allows easy pushing of the cutter, without gripping. The wide, preferably hand-width, handle avoids the pain and fatigue experienced by users of the prior art cutters.

After cutting of the seam, the seam may be sealed in known fashion. For cutting double layer domestic flooring, a vertically thickened shoe 34 may be used to increase the depth of the shoe 34, and thus to increase the depth of the guiding edge.

We claim:

1. A cutter for cutting seams in overlapping upper and lower flooring materials, in which the edge of the upper flooring material is exposed, the cutter comprising:

a body having a handle defining an upper end of the body and having a forward longitudinal end and a rearward longitudinal end;

a base defining a lower end of the body and elongated in the longitudinal direction for supporting the body on one of the upper and lower overlapping flooring materials, and having a first guiding edge extending between the forward longitudinal end and the rearward longitudinal end of the body;

a foot connected to the body adjacent to the base for supporting the body on the other of the lower and upper flooring material and having a second guiding edge extending between the forward longitudinal end and rearward longitudinal end of the body;

a blade slidably disposed against the body between the foot and the base for cutting the flooring material;

one of the first and second guiding edges having a laterally recessed portion between the forward longitudinal end and the rearward longitudinal end of the body, so that the vertical edge of the upper flooring material does not contact the guiding edge in the recessed portion in use;

fastening means for fastening the blade at a chosen position in relation to the body.

2. The cutter of claim 1 in which the foot has a first lower surface and the base has a second lower surface and at least one of the first lower surface and the second lower surface include longitudinal grooves extending from the forward longitudinal end to the rearward longitudinal end of the body.

3. The cutter of claim 1 in which the blade is retractable and located at one end of the cutter and further comprising a second retractable blade located at the other end of the cutter, the recessed portion extending along at least one of the first and second guiding edges between the blades.

4. The cutter of claim 1 in which the one of the first and second guiding edges is graded smoothly across the recessed portion.

5. The cutter of claim 3 in which the foot is vertically adjustable in relation to the base.

6. The cutter of claim 5 in which the other of the guiding edges includes a laterally recessed portion extending along the other of the first and second guiding edges between the blades.

7. The cutter of claim 6 in which the fastening means is a screw rotatable through a first position in which the blade may be adjusted to a second position in which both the blade and the foot may be adjusted.

8. The cutter of claim 7 in which the combined width of the foot and the base is greater than 5 cm.

9. The cutter of claim 8 in which the handle is oriented substantially perpendicularly to the first and second guiding edges.

10. A cutter for cutting seams in upper and lower overlapping flooring materials, in which the edge of the upper flooring material is exposed, the cutter comprising:

a body having a handle defining an upper end of the body, and having a forward longitudinal end and a rearward longitudinal end and a slot oriented forward and downward in the body, the slot being open laterally;

a blade slidably disposed against the body and adjacent the slot for cutting the flooring materials;

a base defining a lower end of the body and elongated in the longitudinal direction for supporting the body on one of the upper and lower overlapping flooring materials, and having a first guiding edge extending between the forward longitudinal end and the rearward longitudinal end;

a foot connected to the body adjacent to the base for supporting the body on the other of the lower and upper flooring materials and having a second guiding edge extending between the forward longitudinal end and the rearward longitudinal end of the body; and blade fastening means for fastening the blade at a chosen position in relation to the body between the foot and the base upon upward and rearward pressure on the blade, the blade fastening means including a member connected to and protruding from the blade into the slot, the member having parts separated from each other in the direction of the slot for contacting the walls of the slot and having a high degree of friction with the slot.

11. The cutter of claim 10 in which the walls of the slot are serrated and the member includes at least one angular edge disposed on a lengthwise extremity of the member so that the angular edge contacts the serrated walls on rotation of the blade.

12. The cutter of claim 10 in which the member comprises at least two pins connected to each other in parallel and to the blade and extending into the slot, the pins having a high degree of friction with the slot.

13. The cutter of claim 12 in which the pins are integral with the means for adjusting the blade within the body, the blade includes openings for receiving the pins, and the pins pass through the openings in the blade.

14. The cutter of claim 13 in which the pins have angular sides for contacting the walls of the slot.

15. The cutter of claim 14 in which the foot is vertically adjustable in relation to the base, the blade is retractable and located at one end of the cutter, and further including a second retractable blade located at the other end of the cutter.

16. The cutter of claim 1 further including a spacing plate disposed between the foot and the base, the blade being disposed between one of the spacing plate and the foot and the base.

17. A cutter for cutting seams in overlapping upper and lower flooring materials, in which the edge of the upper flooring material is exposed, the cutter comprising:

a body having a handle defining an upper end of the body and having a forward longitudinal end and a rearward longitudinal end;

a blade slidably disposed against the body for cutting the flooring material;

a base defining a lower end of the body and elongated in the longitudinal direction for supporting the body on one of the upper and lower overlapping flooring materials, and having a first guiding edge extending between the forward longitudinal end and the rearward longitudinal end;

a foot slidably and adjustably disposed against the body adjacent to the base for supporting the body on the other of the lower and upper flooring materials and having a second guiding edge extending between the forward longitudinal end and the rearward longitudinal end of the body;

the foot and base having combined with greater than 5 cm., and the handle being oriented substantially perpendicularly to the first and second guiding edges; and fastening means for fastening the blade at a chosen position in relation to the body.

18. The cutter of claim 17 in which the foot and base are adjustable in vertical height in relation to each other.

* * * * *